US005876224A

United States Patent [19]

Chadbourne

[11] Patent Number: 5,876,224

[45] Date of Patent: Mar. 2, 1999

[54] BUS BAR ADAPTOR

[75] Inventor: Christopher G. Chadbourne, Nashua, N.H.

[73] Assignee: Framatome Connectors USA Inc., Norwalk, Conn.

[21] Appl. No.: 842,337

[22] Filed: Apr. 24, 1997

[51] Int. Cl.[6] ..... H01R 25/00

[52] U.S. Cl. ..... 439/110; 439/121; 439/801

[58] Field of Search ..... 439/801, 94, 110, 439/121, 116

[56] References Cited

U.S. PATENT DOCUMENTS 3,551,876 12/1970 Walter ..... 439/110
3,727,171 4/1973 Coles et al. ..... 439/110
4,234,239 11/1980 Wilmes et al. ..... 439/94
4,269,471 5/1981 Woertz ..... 439/94

*Primary Examiner*—Gary Paumen
*Attorney, Agent, or Firm*—Perman & Green, LLP

[57] ABSTRACT

The invention resides in a connector having a body extending in a lengthwise direction along a central axis. The body has a first portion defining at least one conductor engaging surface and having a second portion with at least one tracking engaging member extending therefrom. The at least one tracking engaging member being rigidly, nonmovably connected to the body. The body further has means for locking it to a track by causing the at least one tracking gauging member to wedge against a corresponding surface associated with the track.

17 Claims, 1 Drawing Sheet

BUS BAR ADAPTOR

BACKGROUND OF THE INVENTION

The present invention relates to an adapter used in electrical connectors, and relates more particularly to an improvement in such adapters whereby the adapter is capable of slidably connecting to a rail type bus bar power distribution system and connecting an elongated conductor to the rail system in various orientations relative thereto independently of the adaptor/rail connection.

Rail-type bus bar power distribution systems are known. Such systems can handle up to four feeders per phase and are rated at 13,000 to 15,000 amps per phase. The rails of the bus-bar can be found in various lengths and have an insulated platform that can easily be mounted by bolting through a wireway or junction box. Such rails provide an unlimited tapping capability up to the maximum amperage rating limits for the bus bar.

Previously, the tapping of electrical energy from the bus bar was heretofore accomplished by using a connector having a spring body design that locked into the dove-tailed rail upon the tightening of a set screw which threaded through the top part of the spring body design thereby compressing the wire conductor against the bottom of the connector and spreading the spring dove-tail configuration to effect the connection with the correspondingly shaped grooves in the dove-tailed rail.

However, it is often desirable to connect conductors to a bus bar rail of the type which use compression terminals formed on their ends. The use of such compression terminals on a conductor is desirable because it provides a high conductivity, seamless medium between which electricity passes. This is because the compression terminal or lug is often made of high conductivity material, such as, seamless electrolytic wrought copper and electro-tin plated to prevent corrosion. The compression terminals further can be die or color coded in order to match the correspondingly colored coded system rails.

Another drawback with the previously used spring body connectors is that the orientation of the conductor wire which is connected to the bus rail through the connector must be disposed in a parallel orientation relative to the length of the rail members. This is because the conductor cable must be inserted lengthwise with the elongate extent of the rails in order to effect insertion of the conductor end into the body of the connector and for subsequent biasing with the set screw. That is, it is often desirable, if not necessary, to have the conductor wires connected to the adaptor so as to be disposed perpendicularly to the rail bus system in order to make the proper connection.

Accordingly, it is an object of the present invention to provide a bus bar adapter capable of being used in a rail bus bar system wherein the adapter is capable of connecting conductors having various end configurations, including compression terminal type ends.

Still a further object of the invention is to provide an adapter of the aforementioned type wherein the conductor is capable of being connected to the adapter at angles other than one which orients the conductor parallel to the length of the rail bus bar at the connection point.

Still a further object of the invention is to provide an electrical adapter the aforementioned type wherein the adapter is capable of connecting a conductor having either a compression terminal or mechanical terminal end in varied configurations and/or orientations with the rail bus bar.

Other objects and advantages of the invention will become known by the foregoing description in the appended claims.

SUMMARY OF THE INVENTION

The invention resides in a connector having a body extending in a lengthwise direction along a central axis. The body has a first portion defining at least one conductor engaging surface and having a second portion with at least one tracking engaging member extending therefrom, with at least one tracking engaging member being rigidly, nonmovably connected to the body. The body further has means for locking it to a track by causing the at least one tracking engaging member to wedge against a corresponding surface associated with the track.

Ideally the first and second portions are integrally connected with one another and the means for locking the body to a track includes an opening formed in the body and extending perpendicularly to the central axis. The threaded opening receives a set screw therein having an end adapted to engage a surface of a track to effect displacement of the body relative to the track.

Preferably, the second portion has a pair of track engaging members configured to have a dovetailed shape and the at least one conductor engaging surface being sized and shaped to receive a correspondingly sized and shaped conductor lug surface and the track engaging members are elongated in a direction extending parallel to the central axis.

In one embodiment, the first body portion is T-shaped as defined by a vertically extending part and an intersecting horizontally extending part with the threaded opening extending through the intersection between the vertically and horizontally extending parts and the threaded opening extending through the central axis perpendicularly thereto.

DETAILED DESCRIPTION OF THE PREFERRED EMBODIMENT

Figure 1:
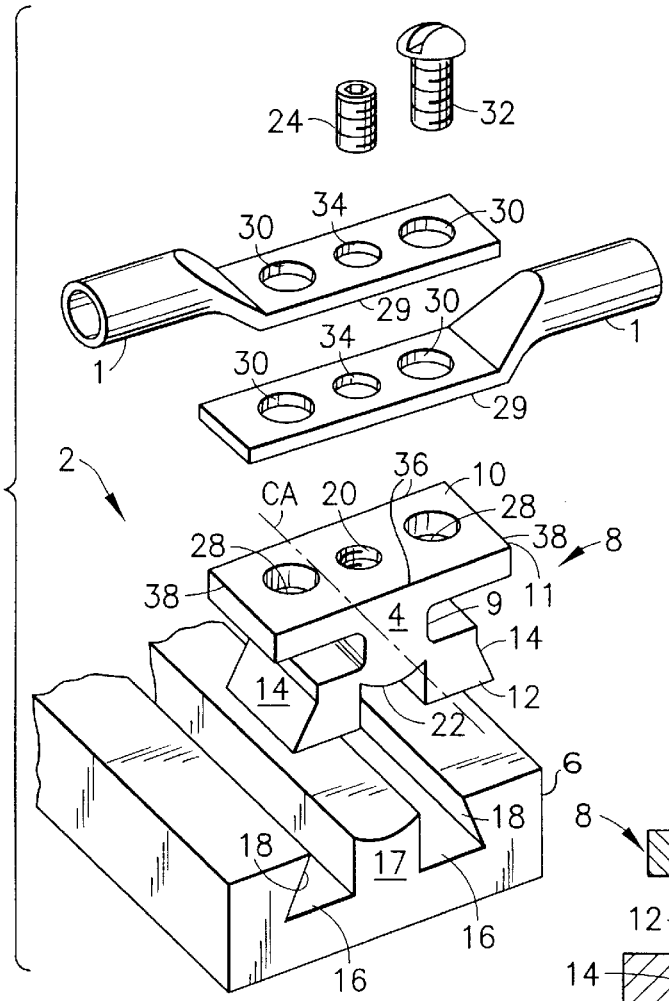
FIG. 1 is a perspective exploded view of the bus bar adapter of the present invention.

FIG. 1 shows the adapter 2 in accordance with the invention. In the illustrated embodiment of FIG. 1, the adapter 2 is comprised of a body 4 extending lengthwise along a central axis CA and is adapted for sliding connection within the bus bar rail 6 for connection with compression lugs 1,1. The adaptor 2 is made from a highly conductive metal, such as, aluminum alloy or the like, and can be formed by machining, extruding or by a molding process to create a given shape. As illustrated, the adaptor 2 is configured to be slid into the bus bar rail 6 in the direction parallel to the length of the rail 6 such that the adaptor is positionable therealong at infinite locations. Also, it should be understood that in the context of the following disclosure, like numerals referenced in different embodiments correspond to similar elements in the different embodiments.

The body 4 has a first portion 8 which extends generally perpendicularly to the central axis CA and has a generally T-shaped region as defined by a vertically extending part 9 and an intersecting horizontally extending part or flange 11 with a flat upper surface 10. The body 4 has a second portion 12 integrally connected to the first portion 8 and is defined primarily by a dove-tail structure 13. The structure 13 includes track engaging surfaces 14,14 which extend obliquely therefrom and outwardly of the central axis CA.

The track engaging surfaces forming part of a dove-tail structure 13 engaging within correspondingly shaped longitudinally extending grooves 16,16 in the rail 6 are defined by correspondingly formed oblique surfaces 18,18 separated by an intermediate wall 17. The surfaces 14,14 of the dove-tail structure 13 engage with the oblique surfaces 18,18 in the rail 6 upon the application of a bias in the direction N extending normally to the central axis direction CA. A threaded opening 20 is formed through the body 4 so as to extend perpendicularly to the central axis CA and through the intersection between the vertically extending part 9 and horizontally extending flange 11. Within the opening 20 is provided a set screw 24 which biases the adaptor 2 within the rail 6.

Figure 2:
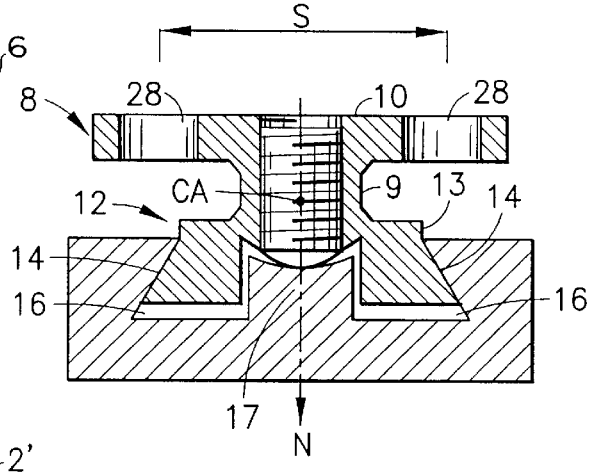
FIG. 2 is a vertical section through a rail bus bar with an adapter shown connected in a locked condition.

The second portion 12 of the body also has a chamfered surface 22 which communicates with the threaded opening 20. The correspondingly sized and shaped threaded set screw 24 extends beyond the surface 22 when the adaptor 2 is in the locking condition shown in FIG. 2. Thus, when the set screw 24 is rotated in a tightening direction, the end of the set screw is caused to abut against the top surface of the separation wall 17 of the bus rail 6, and thereafter cause the correspondingly shaped oblique surfaces 14,14 and 18,18 of the dove-tail section 13 and the grooves 16,16 of the rail 6, respectively, to engage and lock against one another. In this way, the adaptor is caused to be locked against sliding and movement normal to the length of the grooves 16,16 on the bus bar 6 at any point therealong to effect electrical contact therebetween.

Referring back to FIG. 1, and to the first portion 8 of the body, it should be seen that the flange 11 comprising the portion 8 has two openings 28, 28 formed therein. The openings 28, 28 are spaced apart from one another by the dimension S. The lugs 1,1 have contact surfaces 29,29 with spaced mounting openings 30,30 formed therein which are spaced on center from one another by the dimension S such that the lugs 1,1 are capable of being placed down onto the surface 10 of the flange 11 with the flange openings 28,28 disposed in alignment with the corresponding openings 28,28 in the lugs. Thereafter, rivets 32 or other like fastening means are caused to be placed through the aligned mounting openings 30,30 in the lugs 1,1 and thereafter be fastened into the flange openings 28,28 to effect an electrical and mounting connection therebetween.

As illustrated, the flange 11 of the first portion 8 of the body of the adaptor is comprised of long sides 36,36 and short sides 38,38 giving the flange 11 a generally rectangular shape. The lugs 1,1 may further have a third central opening 34,34 which is disposed intermediate the mounting openings 30,30. The third openings 34,34 are so disposed thereon as to be located coincidentally with the threaded central opening 20 in the body 4 of the connector 2. In this way, connection of the compression lugs 1,1 to the adapter surface 10 can be effected either before, after or simultaneously with the mounting of the adapter to the rail bus bar.

The rectangularly shaped flange 11 of the first portion 8 is integrally formed with the body 4 of the connector at any angle relative to the central axis CA, but in the illustrated embodiment, the flange 11 is formed with the long sides 36,36 disposed perpendicularly to the central axis CA and the short sides 38,38 disposed parallel thereto. Thus, an adapter capable of connecting lugs 1,1 at an angle perpendicular to the direction of the rails 16,16 is achieved.

Figure 3:
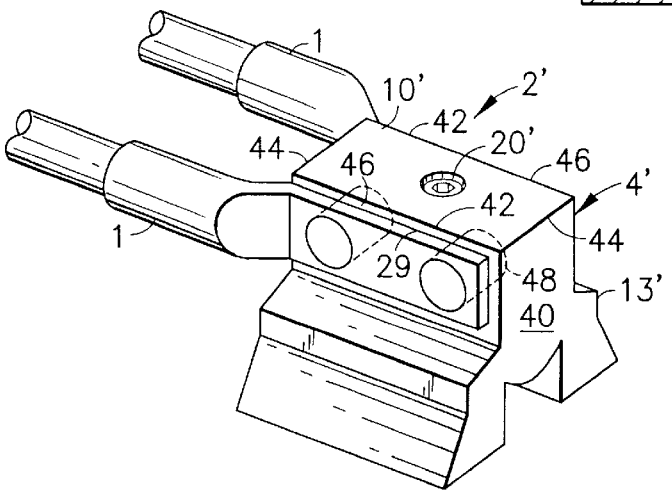
FIG. 3 is a perspective partially fragmentary view showing an adapter connecting a with compression lugs disposed parallel to the orientation of the rails.

Referring now to FIG. 3, a second embodiment of the adapter 2' is illustrated. In the embodiment of FIG. 3, the adapter 2' has a body 4' which is constituted by a generally block-like configuration or member 40. The block member 40 is integrally connected with the dove-tailed shaped section 13'. A threaded opening 20' is formed through the body 4' in a direction perpendicularly to the central axis CA and communicates with the chamfered lower surface 22.

The block portion 40 as seen in top view has a generally rectangular shape as defined by long sides 42, 42 and short sides 44, 44 giving the block portion 40, as seen from top view, a generally rectangular shape. The rectangular shape of the block portion 40 is such that the long sides 42, 42 are disposed parallel to the central axis CA and the short sides 44,44 thereof are disposed perpendicularly thereto. The body block portion 40 has two vertically disposed sidewalls 46,46, each providing a mounting surface against which the contact surface 29,29 of the lugs 1,1 are connected. A plurality of openings 48,48 may be formed within the block portion 40 to receive the pressed-in rivets 32,32, or other fastening means. In this way, each of the lugs 1,1 in FIG. 3 is capable of connecting to the adapter 2' so as to be disposed parallel to the central axis CA of the adapter, rather than perpendicular to it.

Also, while FIG. 3 illustrates the top surface 10' of the body block portion 40 absent an attached lug, it is well within the purview of the invention to provide a lug of the type illustrated in FIG. 1 having an opening 34 provided for passage of the set screw 24 and to provide corresponding placed openings in the top surface 10' of the connector 2' so as to allow a third such lug of the type shown in FIG. 1 to be mounted in a parallel orientation with respect to the central axis CA.

Figure 4:
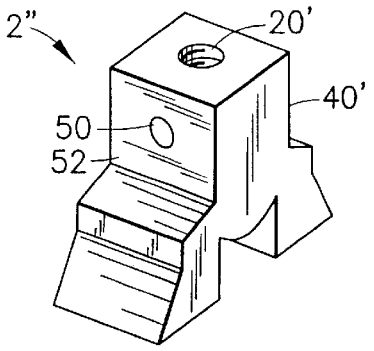
FIG. 4 is a perspective view an adapter which is modified for short barrel and/or single hole lugs.

Referring now to FIG. 4, and to a further embodiment of the adapter 2", it should be seen that the adapter 2' shown in FIG. 4 has a body block portion 40' which is modified to accommodate a shortened single hole compression lug which is accordingly sized lengthwise with respect to the sides 42',42' of the body block 40'. In this embodiment, the body block 40 may include an opening 50 which is provided for the purpose of connecting a lug (not shown) to the contact surface 52 of the body block 40 using a rivet 32.

By the foregoing, an improved bus bar adapter has been described by way of the preferred embodiments. However, numerous modifications and substitutions may be had without departing from the spirit of the invention. For example, the openings 28,28, 48,48 and 50,50 shown respectively in FIGS. 1, 3 and 4 have been described in terms of connection by a pressed-in rivet placed through a mounting opening in each of a lug member. However, it is well within the purview of the invention to connect conductors which would not otherwise have compression lugs 1,1 attached, but rather to connect such conductors through a mechanical connection or even by welding. Also, in the context of the above description, the terms "vertical", "horizontal" are meant to define only relative designations, and should not be construed to mean anything other than a description of relative positions.

Accordingly, the invention has been described by way of illustration rather than limitation.

What is claimed is:

1. An electrical connector comprising:

a body extending in a direction along a central axis, said body having a first portion defining at least one conductor engaging surface and having a second portion with at least one track engaging member extending therefrom, said at least one track engaging member being rigidly non-movably connected to said body; and means for locking said body to a track by causing said at least one track engaging member to wedge against a corresponding surface associated with the track, said means for locking said body to a track includes a threaded opening formed in said body, said threaded opening receiving a set screw therein having an end adapted to engage a surface of a track to effect displacement of said body relative to said track.

2. An electrical connector as defined in claim 1 further characterized in that said threaded opening formed in said body extends perpendicularly to said central axis.

3. An electrical connector as defined in claim 2 further characterized by said said first and second portions being integrally connected with one another.

4. An electrical connector as defined in claim 2 further characterized by said second portion having a pair of track engaging members configured to have a dovetailed shape.

5. An electrical connector as defined in claim 4 further characterized by said at least one conductor engaging surface being sized and shaped to receive a correspondingly sized and shaped conductor lug surface.

6. An electrical connector as defined in claim 5 further characterized in that said track engaging members are elongated in a direction extending parallel to said central axis.

7. An electrical connector as defined in claim 6 further characterized by said first body portion being T-shaped as defined by a vertically extending part and an intersecting horizontally extending part with said threaded opening extending through said intersection between said vertically and horizontally extending parts.

8. An electrical connector as defined in claim 7 further characterized by said threaded opening extending through said central axis perpendicularly thereto.

9. An electrical connector capable of connecting a track bus to at least one conductor of the type having a connecting lug, said connector comprising:

a body extending in a direction along a central axis and having a first portion defining at least one surface adapted to receive in contacting engagement therewith a corresponding surface of a connecting lug and a second portion having at least one track engaging member depending therefrom configured to engage with a busbar track; and means associated with said body for displacing said body relative to a busbar track in a direction perpendicular to said central axis, said means for displacing said body relative to a busbar track includes a threaded opening formed in said body, said threaded opening receiving a set screw therein having an end adapted to engage a surface of a track to effect displacement of said body relative to said track.

10. An electrical connector as defined in claim 9 further characterized in that said threaded opening formed in said body extends perpendicularly to said central axis.

11. An electrical connector as defined in claim 10 further characterized by said first and second portions being integrally connected with one another.

12. An electrical connector as defined in claim 10 further characterized by said second portion having a pair of track engaging members configured to have a dovetailed shape.

13. An electrical connector as defined in claim 12 further characterized in that said track engaging members are elongated in a direction extending parallel to said central axis.

14. An electrical connector as defined in claim 13 further characterized by said first body portion being T-shaped as defined by a vertically extending part and an intersecting horizontally extending part with said threaded opening extending through said intersection between said vertically and horizontally extending path.

15. An electrical connector as defined in claim 14 further characterized by said threaded opening extending through said central axis perpendicularly thereto.

16. An electrical connector as defined in claim 15 further characterized by said two vertically oriented conductor engaging surfaces being adaptable for connection to an associated lug by compression means.

17. An electrical connector comprising:

a body extending in a direction along a central axis, said body having a first portion defining at least one conductor engaging surface and having a second portion with at least one track engaging member extending therefrom, said at least one track engaging member being rigidly non-movably connected to said body; and means for locking said body to a track by causing said at least one track engaging member to wedge against a corresponding surface associated with the track, said first and second portions being integrally connected with one another and said means for locking said body to a track includes a threaded opening formed in said body and extending perpendicularly to said central axis, said threaded opening receiving a set screw therein having an end adapted to engage a surface of a track to effect displacement of said body relative to said track.

* * * * *